US009824634B2

(12) United States Patent
Miwa et al.

(10) Patent No.: US 9,824,634 B2
(45) Date of Patent: Nov. 21, 2017

(54) OLED DISPLAY DEVICE WITH VARIABLE GAMMA REFERENCE VOLTAGE

(71) Applicant: LG Display Co., Ltd., Seoul (KR)

(72) Inventors: Koichi Miwa, Paju-si (KR); Seong-Eok Han, Gimje-si (KR); Junghyun Lee, Paju-si (KR); Yonghan Jo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 20 days.

(21) Appl. No.: 14/973,656

(22) Filed: Dec. 17, 2015

(65) Prior Publication Data

US 2016/0189623 A1 Jun. 30, 2016

(30) Foreign Application Priority Data

Dec. 31, 2014 (KR) ..... 10-2014-0195605

(51) Int. Cl.
*G09G 3/30* (2006.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0439* (2013.01); *G09G 2310/027* (2013.01); *G09G 2310/0286* (2013.01); *G09G 2310/08* (2013.01); *G09G 2320/0233* (2013.01); *G09G 2320/0276* (2013.01); *G09G 2320/0295* (2013.01); *G09G 2320/045* (2013.01); *G09G 2320/0673* (2013.01); *G09G 2340/0428* (2013.01)

(58) Field of Classification Search
CPC . G09G 3/12–3/14; G09G 3/30–3/3291; G09G 2300/043
See application file for complete search history.

(56) References Cited

U.S. PATENT DOCUMENTS

2008/0238953 A1* 10/2008 Ogura ..... G09G 3/3275 345/697
2009/0027377 A1* 1/2009 Kwon ..... G09G 3/3233 345/214
2010/0079423 A1 4/2010 Takei et al.
2012/0169798 A1* 7/2012 Ebisuno ..... G09G 3/325 345/690
2013/0050292 A1* 2/2013 Mizukoshi ..... G09G 3/3291 345/690

(Continued)

FOREIGN PATENT DOCUMENTS

EP 1873745 A1 1/2008
EP 2747066 A1 6/2014

OTHER PUBLICATIONS

European Extended Search Report, European Application No. 15202782.7, dated Apr. 29, 2016, 11 pages.

*Primary Examiner* — Sanghyuk Park
(74) *Attorney, Agent, or Firm* — Fenwick & West LLP

(57) ABSTRACT

An OLED display device includes an OLED display panel on which subpixels are disposed, a gamma reference voltage supply circuit supplying gamma reference voltages that are variable during driving and when sensing a threshold voltage, and a data driver supplying data voltages based on the gamma reference voltages to data lines. The data driver senses a voltage of a sensing node within each of the subpixels in sensing mode. A timing controller controls the data driver, and performs a compensation process based on the voltage sensed by the data driver.

20 Claims, 18 Drawing Sheets

(56) References Cited

U.S. PATENT DOCUMENTS

| | | | | |
|---|---|---|---|---|
| 2013/0093800 | A1* | 4/2013 | Shim | G09G 3/3233 345/690 |
| 2014/0176625 | A1 | 6/2014 | Yoon et al. | |

* cited by examiner

OLED DISPLAY DEVICE WITH VARIABLE GAMMA REFERENCE VOLTAGE

CROSS REFERENCE TO RELATED APPLICATION

This application claims priority from and the benefit under 35 U.S.C. §119(a) of Korean Patent Application Number 10-2014-0195605 filed on Dec. 31, 2014, which is hereby incorporated by reference for all purposes as if fully set forth herein.

BACKGROUND OF THE INVENTION

Field of the Invention

The present invention relates to an organic light-emitting diode (OLED) display device that displays images.

Description of Related Art

Organic light-emitting diode (OLED) display devices have recently been prominent as next generation display devices. Such OLED display devices have some advantages, such as relatively fast response speeds, high contrast ratios, high light emitting efficiency, high luminance levels, and wide viewing angles, since OLEDs able to emit light by themselves are used therein.

Such an OLED display device includes subpixels arranged in the shape of a matrix, each of the subpixels including an OLED, and controls the brightness of selected pixels based on scanning signals. Each of the subpixels of the OLED display device also includes a driving circuit driving the OLED. The OLED driving circuit in each of the subpixels includes a transistor, a storage capacitor, and the like. The transistor of the driving circuit has unique characteristics, such as a threshold voltage, mobility, and the like.

The transistor of the driving circuit (in particular, a driving transistor supplying a current to an OLED) degrades along with the lapse of driving period, whereby the characteristics thereof may change. Thus, the characteristics of one driving transistor may have a difference from those of another driving transistor. Such differences in the characteristics between the driving transistors may be a main reason why subpixels have differences in the degrees of luminance, thereby degrading image quality. Therefore, functions able to sense and compensate for the characteristics of the transistors within individual subpixels have been developed.

In order to sense and compensate for the unique characteristics of a transistor within each of the subpixels, such as a threshold voltage, a saturated voltage of a specific sensing node is sensed (measured) by initializing a specific sensing node of the subpixel to a specific voltage value and subsequently changing the voltage value, and the characteristics of the transistor, such as the threshold voltage, are compensated based on the sensed voltage.

However, this approach of compensating the unique characteristics of a transistor, such as a threshold voltage, does not reflect changes in the unique characteristics of the transistor, such as the threshold voltage. In addition, this approach fails to completely compensate for the unique characteristics, such as the threshold voltage, since a sensor and a compensation circuit of an OLED display device have different resolutions. Consequently, stains may occur on the screen having low-grayscale luminance.

BRIEF SUMMARY OF THE INVENTION

Various aspects of the present invention provide an organic light-emitting diode (OLED) display device able to repeat the operation of sensing and compensating for an updated threshold voltage of a subpixel, and after the lapse of time, correct differences in the threshold voltage between the driving transistors based on changes in the threshold voltage of the driving transistors in order to reduce or remove the differences in the luminance between the subpixels, thereby further improving image quality.

Also provided is an OLED display device able to sense a threshold voltage and changes in the threshold voltage in more precise units in the operation of sensing an initial threshold voltage and an updated threshold voltage in order to more completely compensate for the threshold voltage, thereby removing stains on the screen having low-grayscale luminance.

According to an aspect of the present invention, an OLED display device includes: an OLED display panel on which subpixels are disposed; a gamma reference voltage supply circuit supplying gamma reference voltages that are variable during driving and when sensing a threshold voltage; a data driver supplying data voltages based on the gamma reference voltages to data lines, wherein the data driver senses a voltage of a sensing node within each of the subpixels in sensing mode; and a timing controller controlling the data driver, wherein the timing controller performs a compensation process based on the voltage sensed by the data driver The gamma reference voltage supply circuit may supply the gamma reference voltages within a predetermined gamma reference voltage range between a minimum gamma reference voltage and a maximum gamma reference voltage, and vary at least one of the minimum gamma reference voltage and the maximum gamma reference voltage, thereby varying the gamma reference voltages.

The data driver may include: a digital-to-analog converter (DAC) supplying the data voltages based on the gamma reference voltages to the data lines; and an analog-to-digital converter (ADC) sensing a voltage of a sensing node within each of the subpixels in the sensing mode.

The DAC may supply the data voltages based on the gamma reference voltages in a predetermined gamma reference voltage range, and supply the data voltages based on the gamma reference voltages in a range narrower than the predetermined gamma reference voltage range to the data lines when the threshold voltage is updated The ADC may sense a threshold voltage of a driving transistor of each of the subpixels when sensing the initial threshold voltage, and sense a change in the threshold voltage of the driving transistor of each of the subpixels when the threshold voltage is updated.

The DAC may supply the data voltages based on the gamma reference voltages within the predetermined gamma reference voltage range to the data lines during normal driving.

According to the present invention as set forth above, the operation of sensing and compensating for the updated threshold voltage of a subpixel is repeated, and after the lapse of time, differences in the threshold voltage between the driving transistors based on changes in the threshold voltage of the driving transistors are corrected. It is therefore possible to reduce or remove the differences in the luminance between the subpixels, thereby further improving image quality.

In addition, according to the present disclosure, it is possible to sense a threshold voltage and changes in the threshold voltage in more precise units in the operation of sensing an initial threshold voltage and an updated threshold voltage. It is therefore possible to better compensate for the threshold voltage, whereby no stains form on the screen having low-grayscale luminance.

Also provided is an organic light-emitting diode display device having an organic light-emitting diode display panel, a data driver, and a gamma reference voltage supply circuit. The organic light-emitting diode display panel includes a subpixel having a driving transistor coupled to a sensing node and a data line coupled to the subpixel. The data driver drives a data voltage signal onto the data line based on gamma reference voltages, and to senses a voltage of the sensing node during a threshold voltage sensing mode. Furthermore, the data driver supplies the data voltage signal during both the threshold voltage sensing mode and a display driving mode corresponding to image display. The gamma reference voltage supply circuit supplies the gamma reference voltages to the data driver. The gamma reference voltage has a first voltage range during the display driving mode and a second voltage range different than the first voltage range during the threshold voltage sensing mode.

In some embodiments, the light-emitting diode display device further includes a timing controller to control the data driver. The timing controller receives a digital data and compensates the received digital data signal with a stored threshold voltage value.

In some embodiments, the first voltage range is larger than the second voltage range.

In some embodiments, the second voltage range starts at a voltage level greater than zero volts.

In some embodiments, the gamma reference voltage has the first voltage range during an initial threshold voltage sensing mode and the second voltage range during a update threshold voltage sensing mode.

Also provided is a process for operating an organic light-emitting diode display. During the operation of the organic light-emitting diode display device, a threshold voltage of a driving transistor of a subpixel of the organic light-emitting diode display panel is sensed. During the sensing of the threshold voltage of the driving transistor, a first set of gamma reference voltages in a first voltage range is generated; the driving transistor is driven based on the first set of gamma reference voltages; and the threshold voltage of the driving transistor is determined based on the output of the driving transistor. Additionally, the operation of the organic light-emitting diode display, the driving transistor is operated. During the operation of the driving transistor, a second set of gamma reference voltages in a second voltage, different than the first voltage range, range is generated; a data signal corresponding to a brightness level of the subpixel is received; a drive voltage signal is generated based on the received data signal and the generated second set of gamma reference voltages; and the driving transistor is driven based on the drive voltage.

In some embodiments, the second voltage range is larger than the first voltage range.

In some embodiments, the first voltage range starts at a voltage level greater than zero volts.

In some embodiments, the process further senses an initial threshold voltage of the driving transistor. To sense the initial threshold voltage of the driving transistor, a third set of gamma reference voltages in the second voltage range is generated; the driving transistor is driven based on the third set of gamma reference voltages; and a threshold voltage of the driving transistor is determined based on an output of the driving transistor.

In some embodiments, during the operation of the driving transistor, the received data signal is compensated based on the threshold voltage of the driving transistor.

In some embodiments, during the sensing of the threshold voltage of the driving transistor, the stored threshold voltage of the driving transistor is updated based on the output of the driving transistor.

In some embodiments, during the sensing of the threshold voltage of the driving transistor, an output node of the driving transistor is coupled to a reference voltage to charge a capacitor connected between an input node of the driving transistor and the output node of the driving transistor; and responsive to the capacitor being charged, the output node of the driving transistor is coupled to a sensing circuit.

In some embodiments, the sensing circuit is an analog-to-digital converter circuit.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
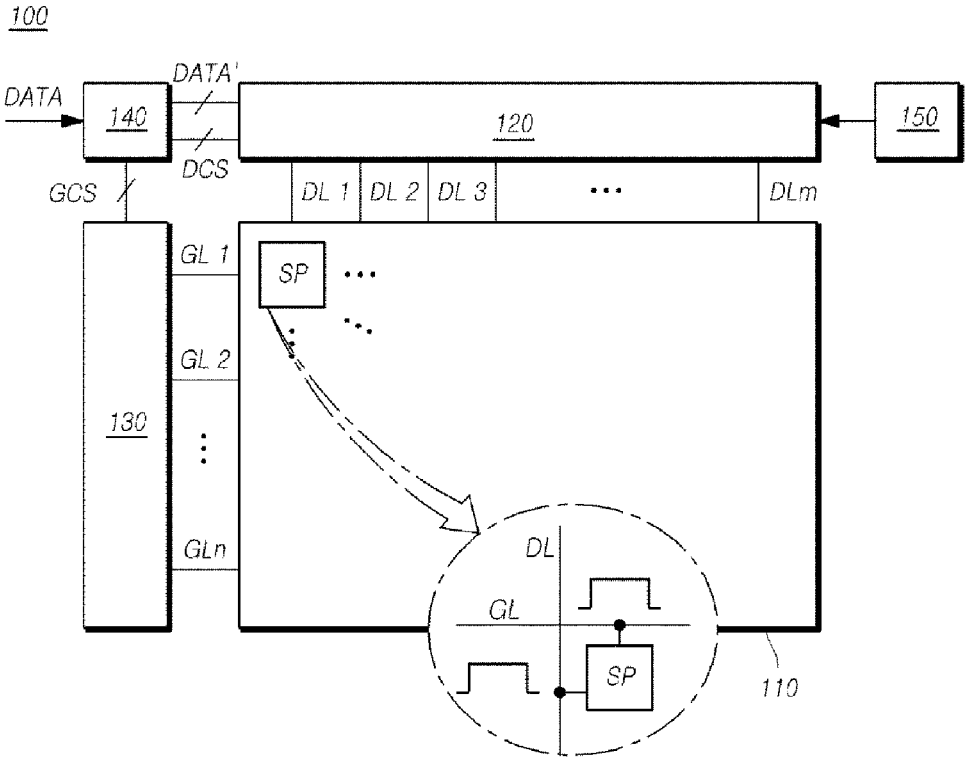
FIG. 1 is a configuration diagram illustrating an organic light-emitting diode (OLED) display device according to exemplary embodiments.

Reference will now be made in detail to embodiments of the present invention, examples of which are illustrated in the accompanying drawings. Throughout this document, reference should be made to the drawings, in which the same reference numerals and signs will be used to designate the same or like components.

It will also be understood that, although terms such as "first," "second," "A," "B," "(a)" and "(b)" may be used herein to describe various elements, such terms are used to distinguish one element from another element. The substance, sequence, order or number of these elements is not limited by these terms. It will be understood that when an element is referred to as being "connected to" or "coupled to" another element, not only can it be "directly connected" or "coupled to" the other element, but also can it be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a configuration diagram illustrating an organic light-emitting diode (OLED) display device 100 according to exemplary embodiments.

Referring to FIG. 1, the OLED display device 100 according to the exemplary embodiments includes an OLED display panel 110, a data driver 120, a gate driver 130, and a timing controller 140.

On the display panel 110, a plurality of data lines DL1 to DLm are disposed in a first direction, a plurality of gate lines GL1 to GLn are disposed in a second direction, and a plurality of subpixels are disposed in the shape of a matrix. The data driver 120 drives the plurality of data lines by supplying data voltages to the plurality of data lines. The gate driver 130 sequentially drives the plurality of gate lines by sequentially supplying scanning signals to the plurality of gate lines. The timing controller 140 controls the data driver 120 and the gate driver 130 by supplying control signals to the data driver 120 and the gate driver 130.

The timing controller 140 starts scanning following the timing realized in each frame, outputs converted image data Data' by converting image data Data input by a host system into a data signal format used by the data driver 120, and regulates data processing at a suitable point in time in response to the scanning.

The gate driver 130 sequentially drives the plurality of gate lines by sequentially supplying scanning signals having an on or off voltage to the plurality of gate lines under the control of the timing controller 140.

The gate driver 130 may be positioned on one side of the OLED display panel 110 or divided into two sections positioned on opposite sides of the OLED display panel 110, according to the drive system of the OLED display panel 110.

The gate driver 130 may include a plurality of gate driver integrated circuits (ICs). The plurality of gate driver ICs may be connected to the bonding pads of the display panel 110 by a tape-automated bonding (TAB) method or a chip-on-glass (COG) method or may be implemented as a gate-in-panel (GIP)-type IC directly disposed on the display panel 110. In some cases, the plurality of gate driver ICs may be directly formed on the display panel 110, forming a portion of the display panel 110.

Each of the plurality of gate driver ICs includes a shift register, a level shifter, and the like.

When a specific gate line is opened, the data driver 120 drives the plurality of data lines by converting the image data Data' received from the timing controller 140 into analog data voltages and supplying the analog data voltages to the plurality of data lines.

The data driver 120 includes a plurality of source driver ICs. The plurality of source driver ICs may be connected to the bonding pads of the display panel 110 by a tape-automated bonding (TAB) method or a chip-on-glass (COG) method or may be directly disposed on the display panel 110. In some cases, the plurality of source driver ICs may be directly formed on the display panel 110, forming a portion of the display panel 110.

Each of plurality of source driver ICs includes a shift register, a digital-to-analog converter (DAC), an output buffer, and the like. In some cases, each source driver IC includes an analog-to-digital converter (ADC) for subpixel compensation. The ADC senses analog voltage values, converts the analog voltage values to digital values, and generates and outputs sensing data.

The plurality of source driver ICs are formed by a chip-on-film (COF) method. In each of the plurality of source driver ICs, one end is bonded to at least one source printed circuit board (SPCB), and the other end is bonded to the OLED display panel 110.

The above-mentioned host system transmits a variety of timing signals including a vertical synchronization signal Vsync, a horizontal synchronization signal Hsync, an input data enable (DE) signal, and a signal clock CLK together with digital video data Data of an input image to the timing controller 140.

The timing controller 140 converts data Data input from the host system into a data signal format used in the data driver 120 and outputs converted data Data'. In addition, the timing controller 140 receives timing signals including a vertical synchronization signal Vsync, a horizontal synchronization signal Hsync, an input DE signal, and a signal clock, generates a variety of control signals based on the input timing signals, and outputs the variety of control signals to the data driver 120 and the gate driver 130 in order to control the data driver 120 and the gate driver 130.

For example, the timing controller 140 outputs a variety of gate control signals (GCSs) including a gate start pulse (GSP), a gate shift clock (GSC) signal and a gate output enable (GOE) signal in order to control the gate driver 130. The GSP controls the operation start timing of the gate driver ICs of the gate driver 130. The GSC signal is a clock signal commonly input to the gate driver ICs to control the shift timing of scanning signals (gate pulses). The GOE signal designates the timing information of the gate driver ICs.

The timing controller 140 outputs a variety of data control signals (DCSs) including a source start pulse (SSP), a source sampling clock (SSC) signal and a source output enable (SOE) signal in order to control the data driver 120. The SSP controls the data sampling start timing of the source driver ICs of the data driver 120. The SSC signal is a clock signal to control the data sampling timing of each of the source driver ICs. The SOE signal controls the output timing of the data driver 120. In some cases, DCSs may further include a polarity (POL) control signal in order to control the polarity of data voltages of the data driver 120. The SSP and SSC signal may be omitted when data Data' input into the data driver 120 is transmitted based on the mini low voltage differential signaling (LVDS) interface specification.

Referring to FIG. 1, the OLED display device 100 further includes a power controller 150 that supplies a variety of voltages or currents to the OLED display panel 110, the data driver 120, the gate driver 130, and the like, or controls the variety of voltages or currents to be supplied to the OLED display panel 110, the data driver 120, the gate driver 130, and the like.

The power controller is also referred to as a power management IC (PMIC).

Figure 2:
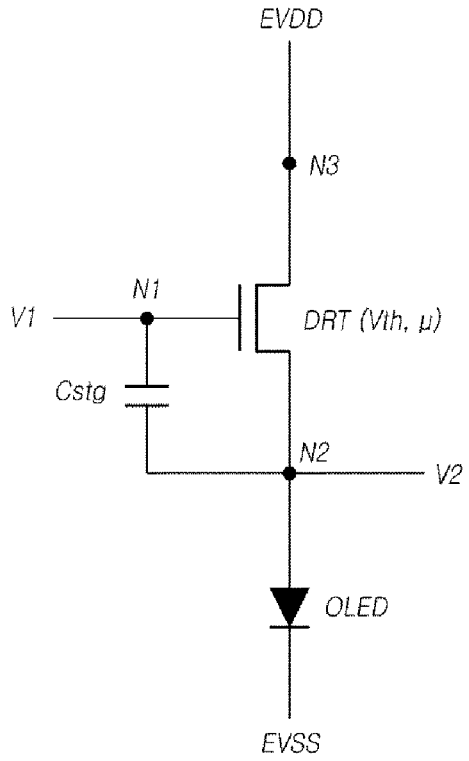
FIG. 2 is a simplified equivalent circuit diagram illustrating a subpixel in the OLED display device according to the exemplary embodiments.

FIG. 2 is a schematic equivalent circuit diagram illustrating a subpixel in the OLED display device 100 according to the exemplary embodiments.

Referring to FIG. 2, each pixel of the OLED display device 100 includes an OLED and a driving circuit driving the OLED. The driving circuit includes a driving transistor DRT driving the OLED by supplying a current to the OLED.

A first node N1 of the driving transistor DRT is a gate node, to which a voltage V1 is applied. A second node N2 of the driving transistor DRT is a source node or a drain node, to which a voltage V2 is applied. A third node N3 of the driving transistor DRT is a drain node or a source node, to which a driving voltage EVDD is applied. Here, the voltage V1 may be a data voltage Vdata corresponding to a relevant subpixel. There is a predetermined potential difference between the voltage V1 and the voltage V2. For example, the voltage V2 may be a reference voltage Vref.

The driving circuit includes a storage capacitor Cstg connecting the first node N1 and the second node N2 of the driving transistor DRT. The storage capacitor Cstg maintains a constant voltage for a period of a single frame.

FIG. 2 schematically and equivalently illustrates the circuit configuration of each of the subpixels. In practice, the driving circuit of each of the subpixels, which drives the OLED, may further include one or more driving transistors in addition to the driving transistor DRT and the storage capacitor Cstg. In some cases, the driving circuit may further include one or more capacitors.

The transistors in each of the subpixels, more particularly, the driving transistor DRT has unique characteristics, such as a threshold voltage Vth, mobility μ, and the like.

The transistor (in particular, the driving transistor DRT) may degrade along with the lapse of driving period, whereby the unique characteristics thereof may change. Thus, the unique characteristics of one driving transistor may be different from those of another driving transistor. Such differences in the characteristics between the driving transistors may cause differences in the degrees of luminance of a subpixel, thereby degrading image quality.

The OLED display device 100 includes a compensation configuration that provides a compensation function for compensating for the differences in the luminance between subpixels.

Figure 3:
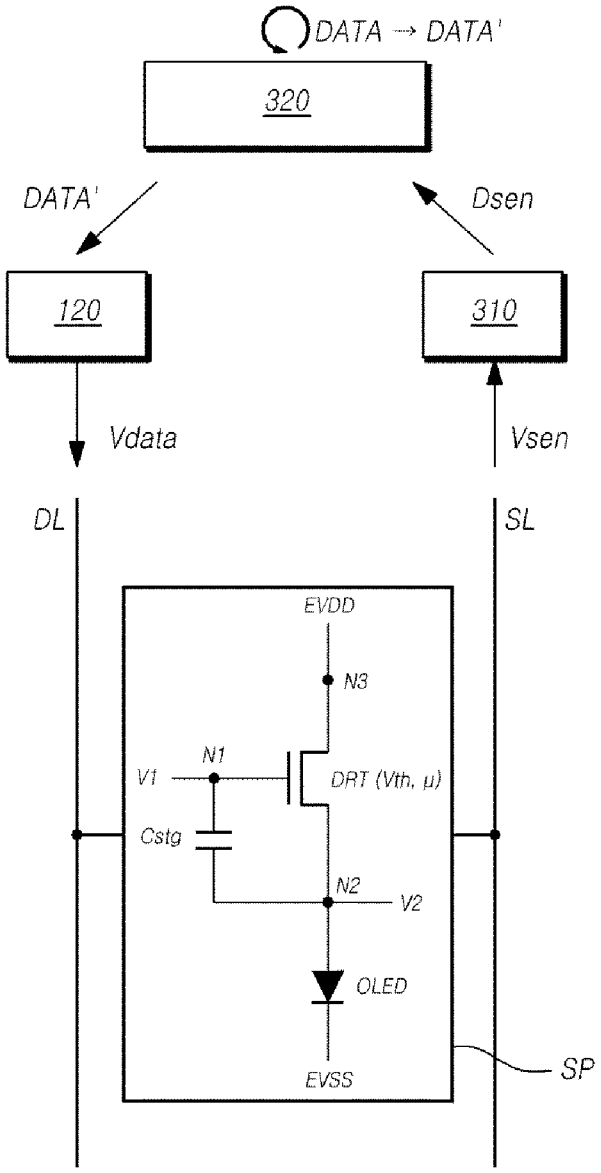
FIG. 3 is a circuit diagram illustrating a compensation configuration of the OLED display device according to the exemplary embodiments.

FIG. 3 is a circuit diagram illustrating a compensation configuration of the OLED display device 100 according to the exemplary embodiments.

Referring to FIG. 3, the OLED display device 100 includes a sensor 310, a compensation circuit 320, the data driver 120, and the like.

The sensor 310 senses a voltage of a sensing node (SN) in each pixel SP and transmits sensed data Dsen to the compensation circuit 320 based on the sensed voltage Vsen. The sensor 310 may be, for example, an ADC.

The ADC may be electrically connected to the sensing node in each pixel through a sensing line SL. The ADC converts the voltage Vsen of the sensing node, sensed through the sensing line SL electrically connected to the sensing node SN in the each pixel, into digital values and generates the sensed data Dsen based on the converted digital values.

The sensor 310 corresponding to the ADC may be provided in plurality, and a single sensor 310, that is, a single ADC may be included in a single source driver IC.

The compensation circuit 320 performs a compensation process based on the received sensed data Dsen. The compensation process may be the process of determining a data compensation amount ΔData by which data Data of each of the subpixels is changed based on the received sensed data Dsen and saves the data compensation amount ΔData in a memory (not shown).

In addition, the compensation process may include an operation of changing the data Data output from a host system based on the data compensation amount ΔData. The data changing operation may acquire changed data Data' by adding the data compensation amount ΔData to the data Data outputted from the host system (Data'=Data+ΔData).

The compensation circuit 320 may be disposed within the timing controller 140

A description of a method and principle of sensing a threshold voltage of the driving transistor DRT in the each pixel on the OLED display panel 110 will be described with reference to FIG. 4 and FIG. 5.

Figure 4:
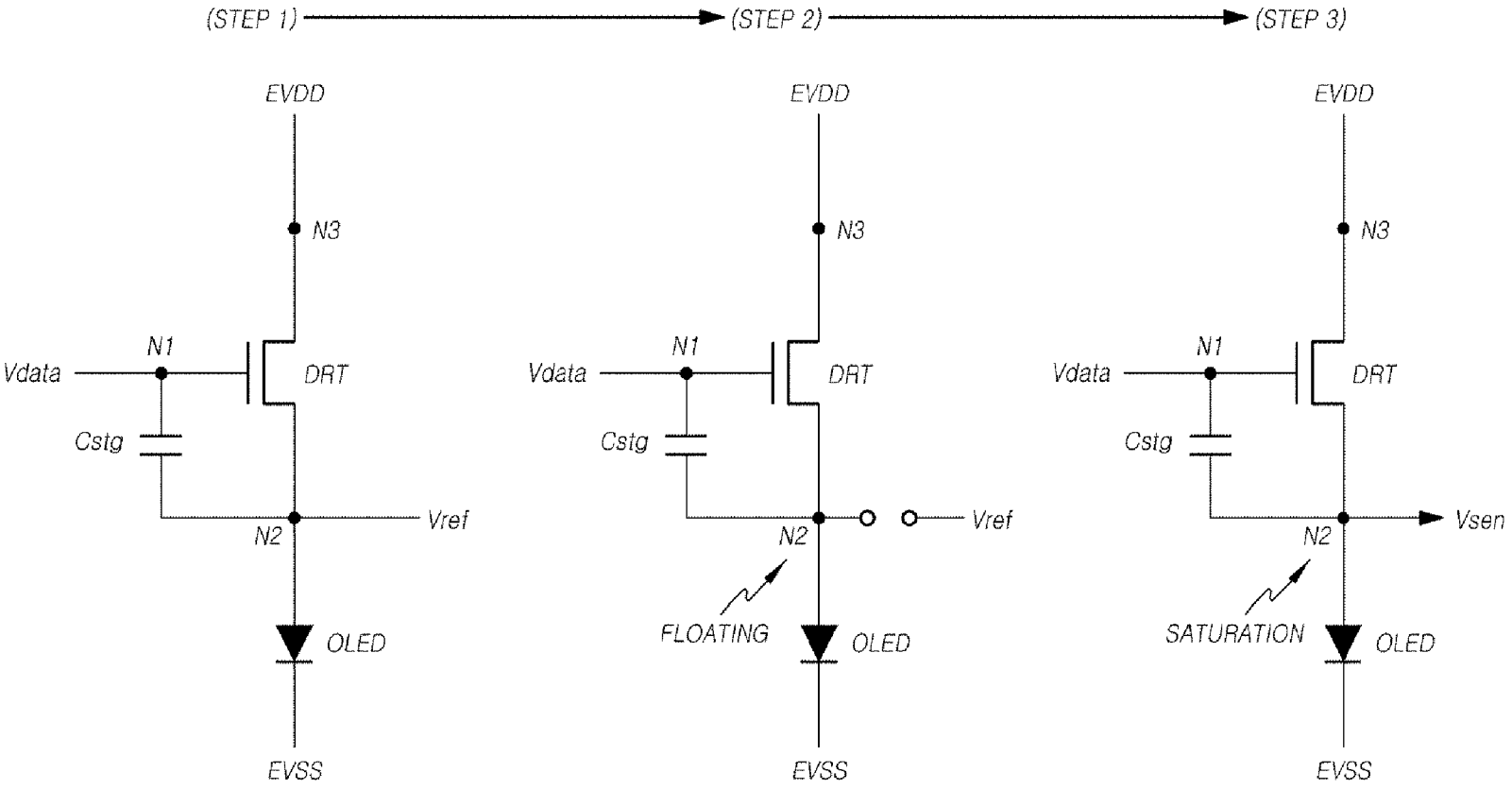
FIG. 4 illustrates an sensing operation during sensing mode in the OLED display device according to the exemplary embodiments.

FIG. 4 illustrates a sensing operation during sensing mode in the OLED display device 100 according to the exemplary embodiments. FIG. 5 is a graph illustrating basic signal waveforms of a driving voltage and a data voltage and changes in the voltage of a sensing node during sensing mode in the OLED display device according to the exemplary embodiments.

Figure 5:
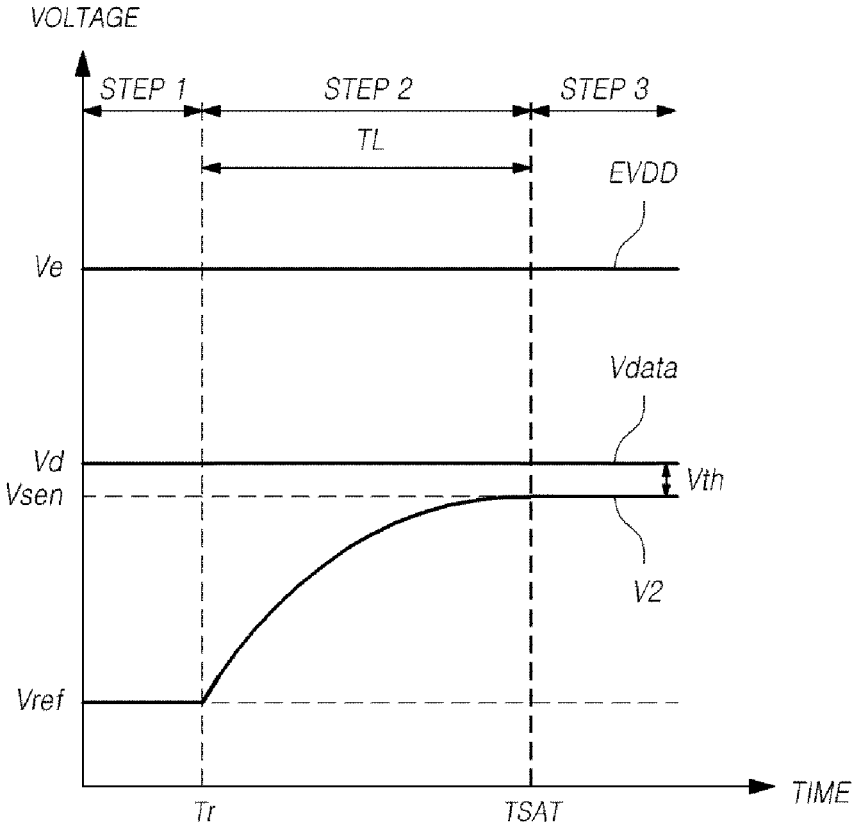
FIG. 5 is a graph illustrating basic signal waveforms of a driving voltage and a data voltage and changes in the voltage of a sensing node during sensing mode in the OLED display device according to the exemplary embodiments.

Referring to FIG. 4 and FIG. 5, the sensing operations in the sensing mode of the OLED display device 100 according to the exemplary embodiments include an initializing operation $\hat{1}$, a sensing node floating operation $\hat{2}$, and a sensing node sensing operation $\hat{3}$.

In the initializing operation $\hat{1}$, after a sensing mode is enabled, a data voltage Vdata and a reference voltage Vref are applied to a first node N1 and a second node N2 of a DRT in a relevant subpixel. It is assumed that the first node N1 of the driving transistor DRT is a gate node of the driving transistor DRT and the second node N2 is a source node of the driving transistor DRT. In addition, it is assumed that the source node of the driving transistor DRT is a sensing node in the relevant subpixel.

In the sensing node floating operation $\hat{2}$, the second node N2 of the driving transistor DRT, i.e. the source node thereof, is floated at a time Tr. The first node N1 of the driving transistor DRT is in the state in which the data voltage Vdata corresponding to an initialization voltage is applied thereto. As the second node N2 of the driving transistor DRT, i.e. the source node thereof, is floated, the voltage of the second node N2 of the driving transistor DRT is boosted.

The voltage of the source node of the driving transistor DRT is boosted toward the data voltage Vdata corresponding to the voltage of the first node N1 of the driving transistor DRT. The voltage boosting continues until the difference between the voltage of the source node and the data voltage Vdata corresponding to the voltage of the first node N1 of the driving transistor DRT reaches the threshold voltage Vth.

As described above, in the second node N2 of the driving transistor DRT, i.e. the source node thereof, the voltage boosting toward the voltage of the first node N1 is called "source following."

In the sensing node sensing operation $\hat{3}$, when the boosting voltage of the second node N2 of the driving transistor DRT is saturated at a point in time Tsat, the saturated voltage of the second node N2 of the driving transistor DRT is sensed.

The voltage saturated in the second node N2 of the driving transistor DRT, i.e. the source node thereof, becomes a voltage (Vdata−Vth=Vd−Vth) obtained by subtracting the threshold voltage Vth of the driving transistor DRT from the data voltage Vdata corresponding to the voltage of the first node N1 of the driving transistor DRT. Here, FIG. 5 illustrates the case in which the threshold voltage Vth of the driving transistor DRT has a positive value. The threshold voltage Vth of the driving transistor DRT may have a negative value.

In the sensing mode, the data voltage Vdata has a constant voltage Vd, and a driving voltage EVDD has a constant voltage Ve.

In the sensing mode, the voltage of the second node N2 of the driving transistor DRT must be sampled and sensed (measured) by the ADC corresponding to the sensor 310 after the voltage of the sensing node of the relevant pixel, i.e. the second node N2 of the driving transistor DRT, is saturated in order to more accurately sense the threshold voltage Vth of the driving transistor DRT.

Figure 6:
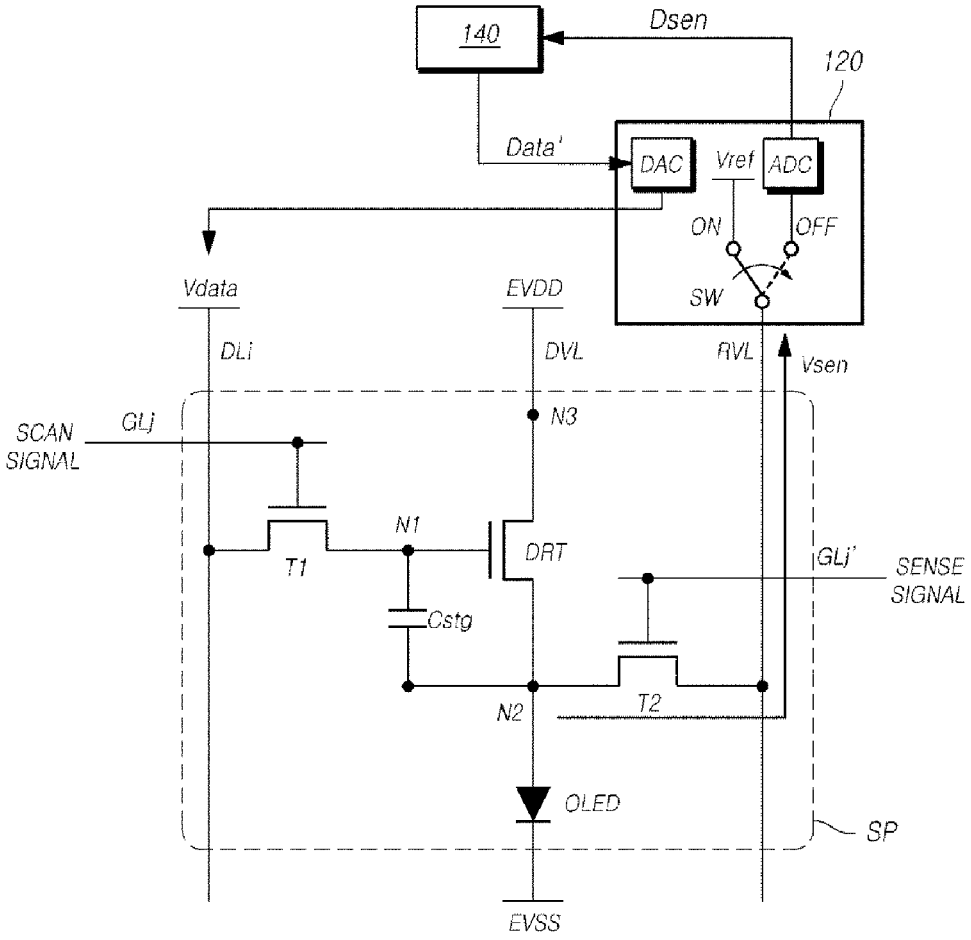
FIG. 6 is a circuit diagram illustrating a sensing and compensation configuration of a subpixel in the OLED display device according to the exemplary embodiments.

FIG. 6 is a circuit diagram illustrating a sensing and compensation configuration of a subpixel in the OLED display device 100 according to the exemplary embodiments.

Referring to FIG. 6, each of the subpixels SP includes: an OLED; a driving transistor DRT having a first node N1 to which a data voltage is applied, a second node N2 connected to a first electrode of the OLED, and a third node electrically connected to a driving voltage line DVL; a first transistor T1 electrically connected between a data line DLi through which the data voltage is supplied and a first node N1 of the driving transistor DRT; a second transistor T2 electrically connected between a reference voltage line RVL through which a reference voltage is supplied and the second node N2 of the driving transistor DRT; and a capacitor Cstg electrically connected between the first node N1 and the second node N2 of the driving transistor DRT.

The subpixel SP also includes an ADC as a configuration for sensing a saturated voltage of the second node N2 of the driving transistor DRT. The ADC is electrically connected to the reference voltage line RVL, and senses a voltage of the second node N2 of the driving transistor DRT.

The ADC is electrically connected to a plurality of reference voltage lines RVL. A single ADC may be provided in every source driver IC.

The use of the above-described ADC allows for efficient and accurate sensing of the threshold voltage of the driving transistor DRT in the subpixel.

Referring to FIG. 6, the analog digital converter ADC senses the voltage of the second node N2 of the driving transistor DRT, converts the sensed voltage Vsen into digital values, and transmits sensed data Dsen including the converted digital values to the time controller 140.

The timing controller 140 receives the sensed data Dsen and compensates for data of each of the subpixels based on the received sensed data Dsen.

For example, the timing controller 140 calculates a data compensation amount ΔData of each of the subpixels based on the sensed data Dsen, saves the calculated data compensation amount ΔData in a memory (not shown), adds the data compensation amount ΔData to data Data about a relevant pixel at a point in time to drive subpixels, and supplies resultant compensated data Data' to a relevant data driver 120 (Data'=Data+ΔData).

As described above, a difference in the threshold voltage between the driving transistors DRTs is compensated through the data compensation. This can reduce or remove differences in luminance between the subpixels, thereby improving image quality.

In the sensing mode, an initial threshold voltage Vth of the driving transistor DRT is sensed by source following, differences in the threshold voltage between the driving transistors DRTs are compensated through the data compensation, a change in threshold voltage (hereinafter referred to as a "threshold voltage change") ΔVth in each DRT is updated and sensed, and a difference in the threshold voltage (Vth+ΔVth) between the driving transistors DRTs is compensated by the data compensation, thereby improving compensation efficiency.

Figure 7:
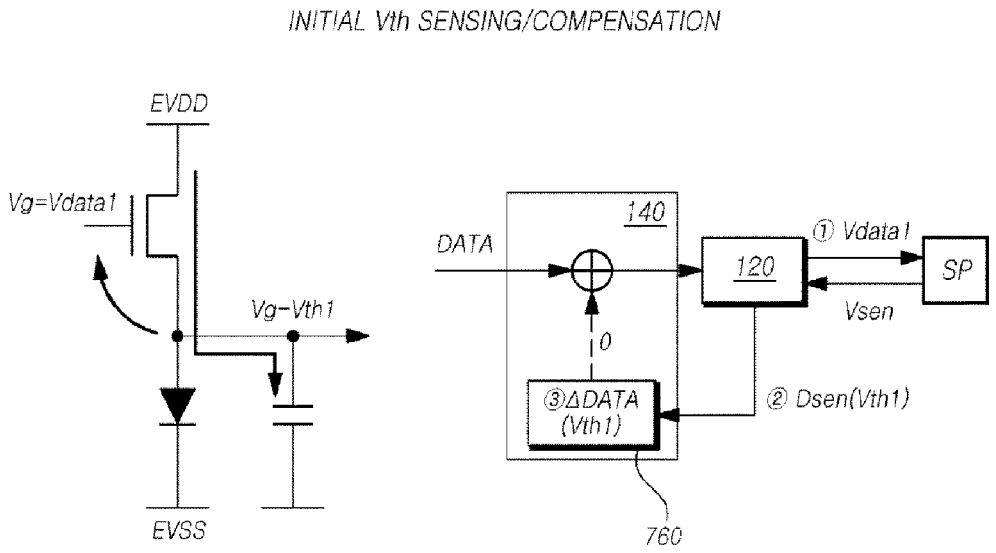
FIG. 7 is a diagram illustrating an initial threshold voltage sensing and compensating configuration of a subpixel in the OLED display device according to the exemplary embodiments.
Figure 8:
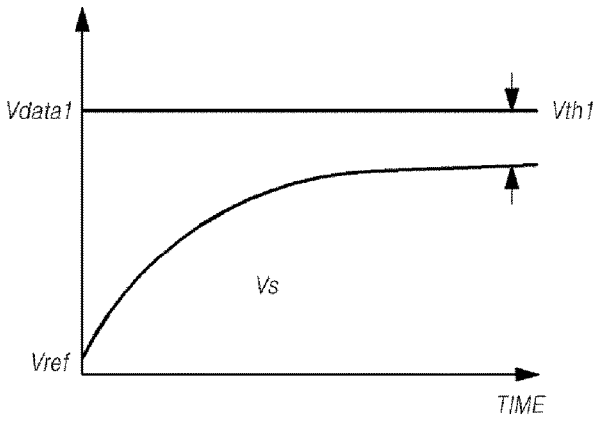
FIG. 8 is a graph illustrating changes in an initial threshold voltage when sensing and compensating for the initial threshold voltage.

FIG. 7 is a diagram illustrating an initial threshold voltage sensing and compensating configuration of a subpixel in the OLED display device 100 according to the exemplary embodiments. FIG. 8 is a graph illustrating changes in an initial threshold voltage when sensing and compensating for the initial threshold voltage. In FIG. 7, digital values are represented as corresponding analog values.

Referring to FIG. 7 and FIG. 8, when sensing and compensating for the initial threshold voltage of the subpixel in the OLED display device 100 according to the exemplary embodiments, in an initializing operation $\hat{1}$, a data voltage Vdata1 and a reference voltage Vref are applied to a first node N1 and a second node N2 of a DRT in a relevant pixel. Afterwards, as the second node N2 of the driving transistor DRT, i.e. the source node thereof, is floated, the voltage of the second node N2 of the driving transistor DRT is boosted.

The voltage of the source node of the driving transistor DRT is boosted toward the data voltage Vdata1 corresponding to the voltage of the first node N1 of the driving transistor DRT as illustrated in FIG. 8. The voltage boosting continues until the difference between the voltage of the source node and data voltage Vdata1 corresponding to the voltage of the first node N1 of the driving transistor DRT reaches the threshold voltage Vth1.

In a sensing node sensing operation $\hat{2}$, when the boosting voltage of the second node N2 of the driving transistor DRT is saturated, the saturated voltage Vg−Vth1=Vdata1−Vth1 of the second node N2 of the driving transistor DRT is sensed.

The ADC of the data driver 120 senses the voltage of the second node N2 of the driving transistor DRT, converts the sensed voltage Vsen into digital values, and transmits the sensed data Dsen (Vth1) to the timing controller 140. The sensed data Dsen (Vth1) includes the converted digital values from the sensed voltage Vsen.

The timing controller 140 calculates a data compensation amount ΔData (Vth1) of each of the subpixels based on the sensed data Dsen (Vth1), and saves the calculated data compensation amount ΔData (Vth1) in a memory 760. For example, as illustrated in FIG. 7, the timing controller 140 calculates the data compensation amount ΔData (ΔVth1) of each of the subpixels using the sensed voltage Vsen corresponding to the sensed data Dsen (Vth1), and saves the calculated result in the memory 760. The initial threshold voltage Vth1 is obtained by subtracting the data voltage Vdata1 from the saturated voltage Vg−Vth1=Vdata1−Vth1 of the second node N2 of the driving transistor DRT which is the sensed voltage Vsen. The timing controller 140 save the obtained initial threshold voltage Vth1 in the memory 760 as the data compensation amount ΔData (ΔVth1).

Figure 9:
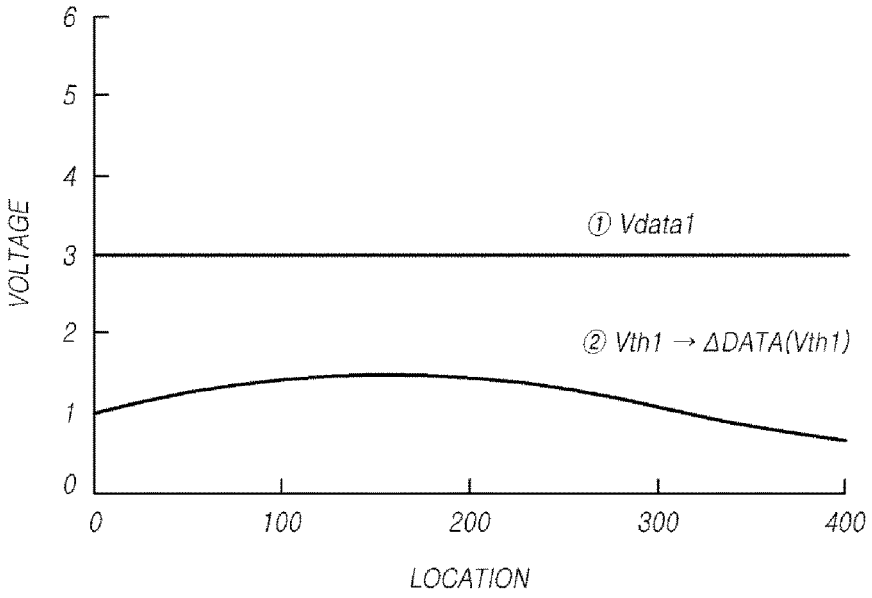
FIG. 9 is a graph illustrating a basic signal waveform of a data voltage and position-specific changes in a threshold voltage when sensing and compensating for an initial threshold voltage.

Since the sensed initial threshold voltage Vth1 varies according to the driving transistor DRTs, differences in the threshold voltage between the driving transistors DRTs occur. FIG. 9 is a graph illustrating a basic signal waveform of a data voltage and position-specific changes in a threshold voltage when sensing and compensating for an initial threshold voltage.

In a subpixel compensating operation $\hat{3}$ from FIG. 7, at a point in time to drive subpixels, the timing controller 140 adds the data compensation amount ΔData (Vth1) to data Data about a relevant pixel SP, and supplies the obtained compensated data Data'=Data+ΔData (Vth1) to the relevant data driver 120. The data driver 120 supplies a compensated data voltage Vdata1'=Vdata1+Vth1 to the relevant subpixel SP. Here, the compensated data voltage Vdata1'=Vdata1+Vth1 is obtained by adding the initial threshold voltage Vth1 to the data voltage Vdata1 of the relevant subpixel SP.

Figure 10:
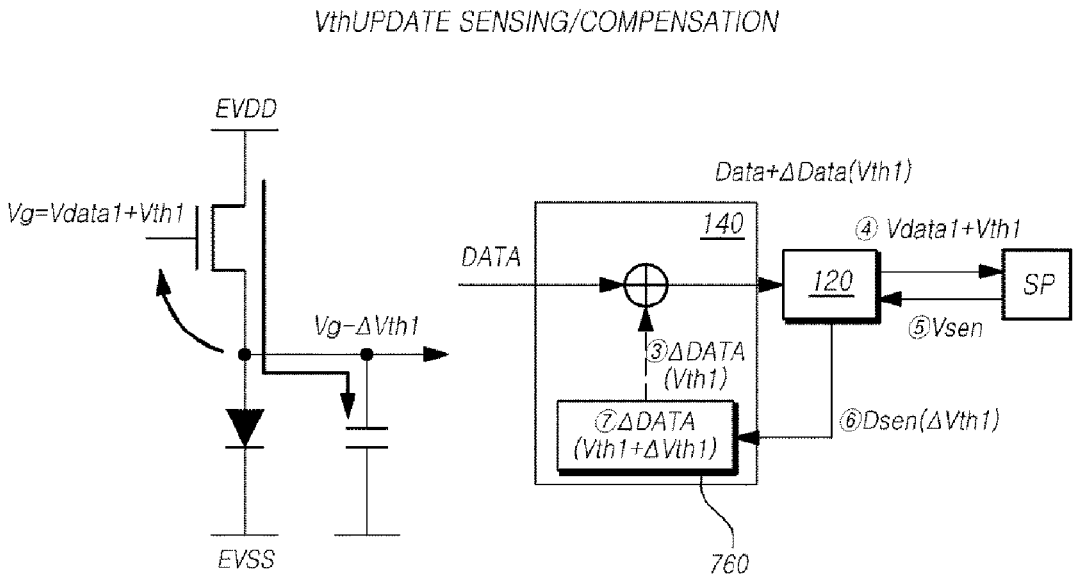
FIG. 10 is a diagram illustrating an updated threshold voltage sensing and compensating configuration of a subpixel in the OLED display device according to the exemplary embodiments.
Figure 11:
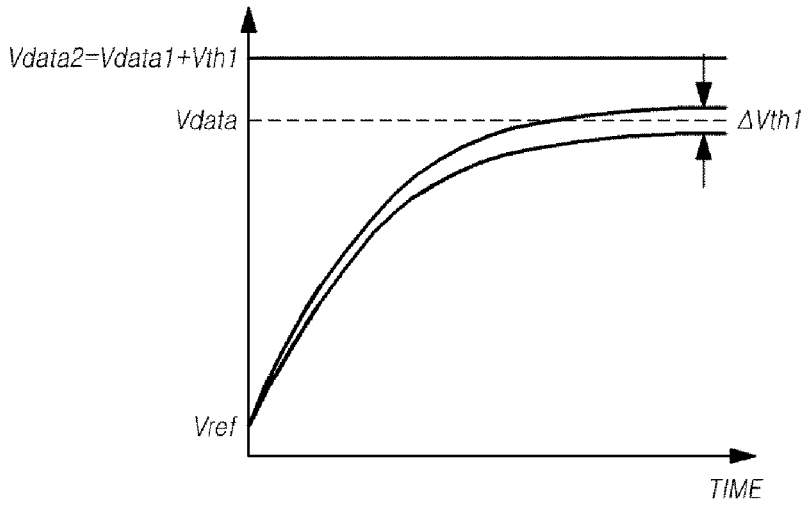
FIG. 11 is a graph illustrating changes in a threshold voltage when sensing and compensation for an updated threshold voltage.

FIG. 10 is a diagram illustrating an updated threshold voltage sensing and compensating configuration of a subpixel in the OLED display device 100 according to the exemplary embodiments. FIG. 11 is a graph illustrating changes in a threshold voltage when sensing and compensation for an updated threshold voltage.

Referring to FIG. 10 and FIG. 11, when sensing and compensating for the updated initial threshold voltage of the subpixel in the OLED display device 100 according to the exemplary embodiments, in operation $\hat{4}$, a compensated data voltage Vdata2=Vdata1+Vth1, obtained by adding the initial threshold voltage Vth1 to the data voltage Vdata1 of the relevant subpixel, is applied to the first node N1 of the driving transistor DRT in the relevant subpixel, and a reference voltage Vref is applied to the second node N2. In a sensing node floating operation, as the second node N2 of the driving transistor DRT, i.e. the source node thereof, is floated, the voltage of the second node N2 of the driving transistor DRT is boosted.

As indicated by $\hat{5}$ in FIG. 10, the voltage of the source node of the driving transistor DRT is boosted toward the data voltage Vdata2 corresponding to the voltage of the first node N1 of the driving transistor DRT (gate of DRT) as illustrated in FIG. 11. Assuming the threshold voltage of the drive transistor DRT has not changed, the voltage boosting $\hat{5}$ is performed until the source node voltage reaches the value Vdata2−Vth1=(Vdata1+Vth1)−Vth1, which is the difference between the threshold voltage Vth1 and the compensated data voltage Vdata2=Vdata1+Vth1. However, when the previously sensed threshold voltage Vth of The driving transistor DRT changes with the lapse of time, the voltage boosting $\hat{5}$ of the source node of the driving transistor DRT continues until the source node voltage is Vdata2−Vth1=(Vdata1+Vth1)−ΔVth1, which is the difference between the compensated data voltage Vdata2=Vdata1+Vth1 and the threshold voltage change ΔVth1.

In a threshold voltage change sensing operation $\hat{6}$, a saturated voltage Vdata2−ΔVth1=(Vdata1+Vth1)−ΔVth1 of the second node N2 of the driving transistor DRT is sensed.

The ADC of the data driver 120 senses the voltage of the second node N2 of the driving transistor DRT, converts the sensed voltage Vsen into digital values, and transmits the sensed data Dsen (ΔVth1) including the converted digital values to the timing controller 140. The notation Dsen (ΔVth1) refers to a Dsen value that is sensed when the transistor threshold has changed by ΔVth1.

In data compensation amount calculating operation $\hat{7}$, the timing controller 140 calculates the threshold voltage change ΔVth1 and a resultant data compensation amount ΔData of each of the subpixels based on the sensed data Dsen (ΔVth1), and saves the calculated threshold voltage change ΔVth1 and the data compensation amount ΔData in the memory 760. For example, as illustrated in FIG. 10, the timing controller 140 calculates the data compensation amount ΔData (Vth1+ΔVth1), i.e. the initial threshold voltage Vth1 and threshold voltage change ΔVth1, of each of the subpixels, using the sensed voltage Vsen corresponding to the sensed data Dsen, and saves the calculated result in the memory 760. Here, the threshold voltage change ΔVth1 is obtained by subtracting the compensated data voltage Vdata2=Vdata1+Vth1 from the saturated voltage Vdata2−ΔVth1=(Vdata1+Vth1)−ΔVth1 of the second node N2 of the driving transistor DRT.

Figure 12:
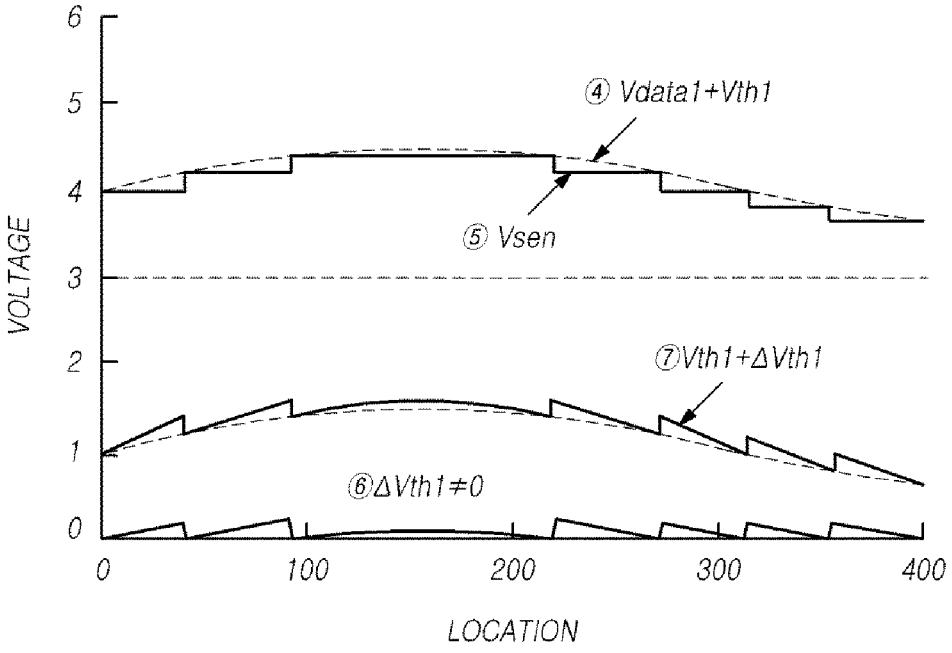
FIG. 12 is a graph illustrating position-specific variations in a data voltage, a data compensation amount, and a threshold voltage when sensing and compensation for an updated threshold voltage.

FIG. 12 is a graph illustrating position-specific variations in a data voltage, a data compensation amount, and a threshold voltage when sensing and compensating for an updated threshold voltage.

In the subpixel compensation operation, to drive subpixels, the timing controller 140 adds the data compensation amount ΔData (Vth1+ΔVth1) to data about a relevant subpixel, and supplies resultant compensated data Data'=Data+ΔData (Vth1+ΔVth1) to the corresponding data driver 120. The data driver 120 supplies a compensated data voltage Vdata' obtained by adding the initial threshold voltage Vth1 and a threshold voltage change ΔVth1 to the data voltage Vdata1 of the corresponding subpixel.

The OLED display device 100 according to the exemplary embodiments repeats the operation of sensing and compensating for the updated threshold voltage of a subpixel, which has been described with reference to FIG. 10. After the lapse of time, differences in the threshold voltage between the driving transistors are corrected based on the threshold voltage changes of the driving transistors. This can reduce or remove the differences in the luminance between the subpixels, thereby improving image quality.

In the OLED display device 100 according to the exemplary embodiments as described above, the DAC of the data driver 120 applying a data voltage to a relevant subpixel, the ADC sensing a threshold voltage Vth, and the memory 760 saving a threshold voltage change ΔVth of the subpixel and a data compensation amount ΔData of the subpixel calculated based on the sensed data Dsen may have different resolutions. A threshold voltage sensing and compensating structure using a DAC, an ADC, and a memory having different resolutions will now be described with reference to the drawings.

Figure 13:
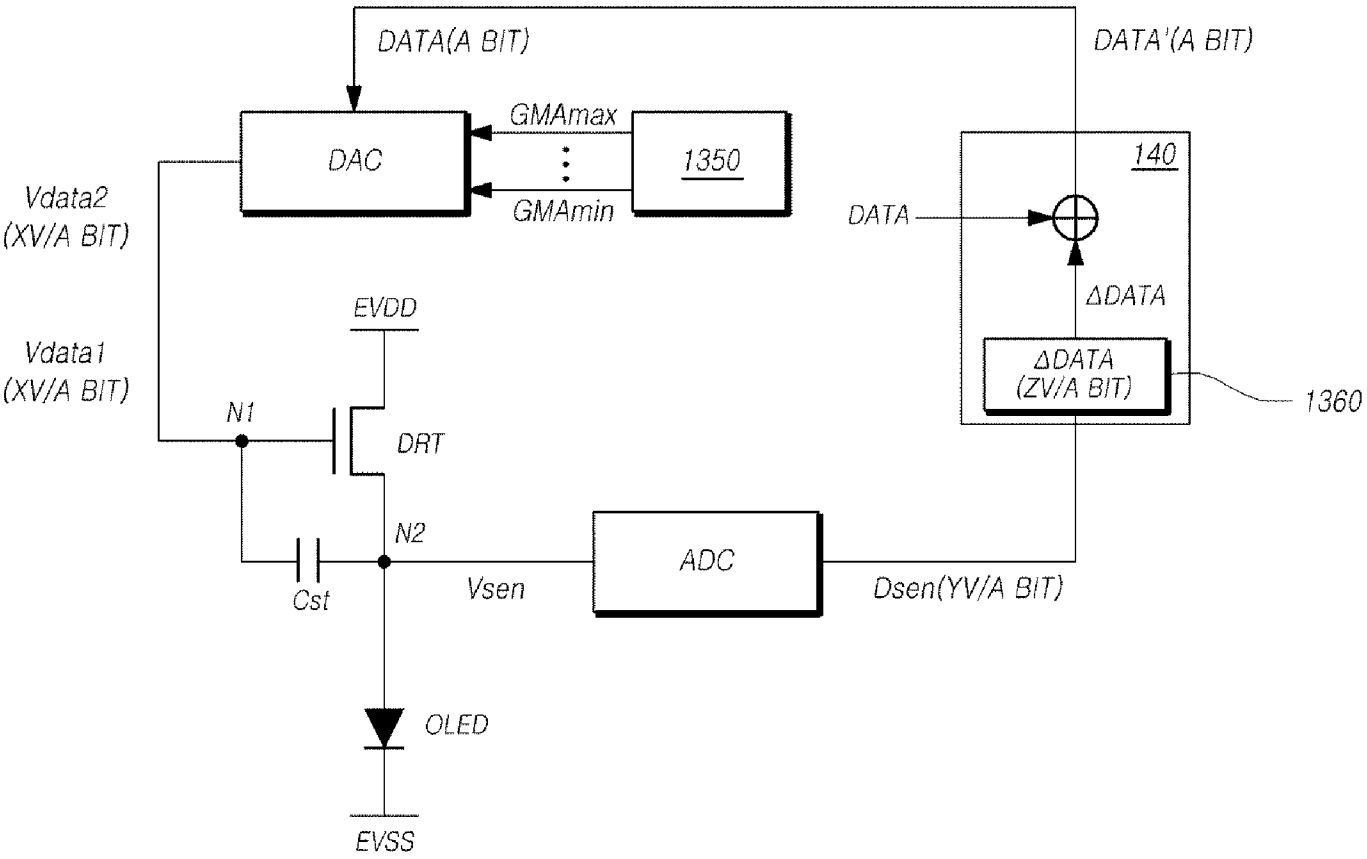
FIG. 13 is a circuit diagram illustrating a configuration for sensing and compensating for an initial threshold voltage of a subpixel in the OLED display device according to the exemplary embodiments.
Figure 14:
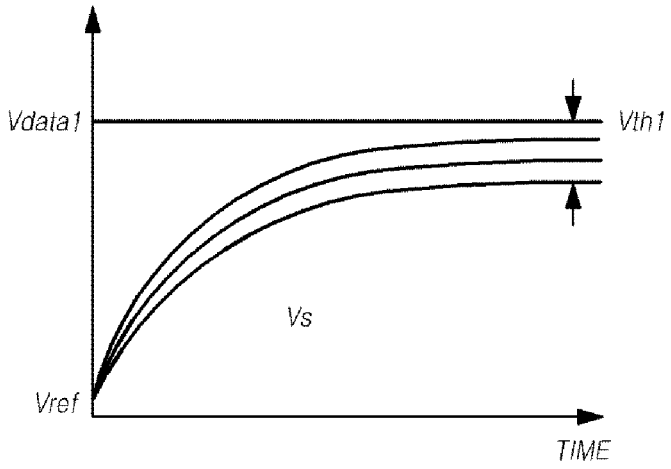
FIG. 14 is a graph showing changes in a threshold voltage when sensing and compensating for an initial threshold voltage.

FIG. 13 is a circuit diagram illustrating a configuration for sensing and compensating for an initial threshold voltage of a subpixel in the OLED display device 100 according to the exemplary embodiments. FIG. 14 is a graph illustrating changes in a threshold voltage when sensing and compensating for the initial threshold voltage.

Referring to FIG. 13 and FIG. 14, the DAC provides the drive transistor DRT with a data voltage Vdata corresponding to the data in the sensing and driving operation. The data may be, for example, A-bit video data.

Further, a gamma reference voltage supply circuit 1350 provides the DAC with $2^A$ gamma reference voltages corresponding to A bits. The gamma reference voltage supply circuit 1350 may be included in the power controller 150 described with reference to FIG. 1, but the present invention is not limited thereto.

A maximum gamma reference voltage may be, for example, X Volts m. The DAC receives the A-bit data from the timing controller 140 and the $2^A$ gamma reference voltages from the gamma reference voltage supply circuit 1350, and provides $2^A$ data voltages Vdata1 to the drive transistor DRT. Thus, an output voltage resolution of the DAC is X V/A bits, and can be expressed as $X/2^A$ V per one bit.

When sensing and compensating for the initial threshold voltage of the subpixel of the OLED display device 100 according to the exemplary embodiments, in the initializing operation $\hat{1}$, the DAC applies a fixed voltage, for example, a data voltage Vdata1 of a V (i.e. "a" Volts), to a first node N1 of the drive transistor DRT within the relevant subpixel. Further, it is assumed that the reference voltage Vref is b V (i.e. "b" Volts).

Afterwards, as a second node N2 of the drive transistor DRT, i.e. a source node of the drive transistor DRT, is floated, the voltage of the source node of the drive transistor DRT is boosted toward the data voltage Vdata1 corresponding to a voltage of the first node N1 of the drive transistor DRT, as illustrated in FIG. 14. The voltage boosting continues until the difference between the voltage of the source node of the drive transistor DRT and the data voltage Vdata1 corresponding to the voltage of the first node N1 of the drive transistor DRT reaches the initial threshold voltage Vth1.

The ADC sensing the voltage of the first node N1 of the drive transistor DRT converts a peak voltage, for example, a sensed voltage Vsen of Y V (i.e. "Y" Volts), into A-bit sensed data Dsen, and transmits the sensed data Dsen to the timing controller 140. Therefore, the sensing voltage resolution of the ADC is Y V/A bits, and can be expressed as $Y/2^A$V per one bit.

In the sensing node sensing operation $\hat{2}$, the ADC can sense the saturated voltage Vg−Vth1=Vdata1−Vth1 of the second node N2 of the drive transistor DRT in units of $Y/2^A$ V. The sensed voltage Vsen (Vth1) of the ADC can be expressed only in increments of $Y/2^A$ V as in FIG. 14 and Table 1.

TABLE 1

| Sensed Vth1 (V) | ADC output |
|---|---|
| $Y/2^A$ | 1 |
| $2Y/2^A$ | 2 |
| $3Y/2^A$ | 3 |
| $4Y/2^A$ | 4 |
| $5Y/2^A$ | 5 |
| $6Y/2^A$ | 6 |

The timing controller 140 calculates the initial threshold voltage Vth1 by subtracting the data voltage Vdata1 from the sensed voltage Vsen corresponding to the sensed data Dsen, i.e. the saturated voltage Vg−Vth1=Vdata1−Vth1 of the second node N2 of the drive transistor DRT, and saves the calculated result in the memory 1360 as the data compensation amount ΔData.

The timing controller 140 saves the threshold voltage Vth1 in the memory 1360 as a voltage per unit bit that is higher than the sensed voltage per unit bit of the ADC.

When calculating the data compensation amount ΔData (Vth1) of each of the subpixels, the timing controller 140 may calculate the data compensation amount ΔData (Vth1) in units of Y V/A-bits=$Y/2^A$ V/bit, which is the sensing voltage resolution of the ADC. To increase a compensation range to compensate for the initial threshold voltage with wide dispersion, the basic unit of the data compensation amount ΔData (Vth1) can be changed. For example, the timing controller 140 calculates the threshold voltage Vth1 of each of the subpixels, for example, in units of Z V/A-bits=$Z/2^A$ V/bit and saves the calculated result in the memory 1360 as the data compensation amount ΔData. Here, Z may be greater than Y. Hereinafter, it is assumed that Z=2Y, but this is not intended to be limiting.

TABLE 2

| Sensed Vth1 (V) | Value stored as ΔData |
|---|---|
| $Y/2^A$ | 1 |
| $2Y/2^A$ | 1 |
| $3Y/2^A$ | 2 |
| $4Y/2^A$ | 2 |
| $5Y/2^A$ | 3 |
| $6Y/2^A$ | 3 |

In the subpixel compensating operation $\hat{3}$, to drive the subpixels at a point of time, the timing controller 140 converts the data compensation amount ΔData (Vth1) saved in the memory 1360 to be harmonious with the output voltage resolution ($X/2^A$ V/bit) of the DAC as in Table 3, and supplies the compensated data Data1'=Data1+ΔData (Vth1) to the data driver 120.

TABLE 3

| Sensed Vth1 (V) | Down-converted ΔData value |
|---|---|
| $Y/2^A$ | 1 |
| $2Y/2^A$ | 1 |
| $3Y/2^A$ | 1 |
| $4Y/2^A$ | 1 |
| $5Y/2^A$ | 1 |
| $6Y/2^A$ | 1 |

Similarly, when sensing and compensating for the updated threshold voltage of a subpixel, in operation $\hat{4}$, the DAC applies the compensated data voltage Vdata1'=Vdata1+Vth1 corresponding to the compensated data Data1'=Data1+ΔData (Vth1) of the relevant subpixel to the first node N1 of the drive transistor DRT within the relevant subpixel. The data voltage Vdata is fixed as a V, and the data compensation amount ΔData (Vth1) converted to be harmonious with the output voltage resolution ($X/2^A$ V/bit) of the DAC is as in Table 3. The compensated data voltage Vdata1'=Vdata1+Vth1 is as in Table 4. That is, the output voltage resolution $X/2^A$ V/bit of the DAC is lower than the sensing voltage resolution $Y/2^A$ V/bit of the ADC, and the other threshold voltages are calculated in terms of the same data compensation amount ΔData (Vth1).

TABLE 4

| Sensed Vth1 (V) | Applied Voltage (V) (DAC output) |
|---|---|
| $Y/2^A$ | $a + X/2^A$ |
| $2Y/2^A$ | $a + X/2^A$ |
| $3Y/2^A$ | $a + X/2^A$ |
| $4Y/2^A$ | $a + X/2^A$ |
| $5Y/2^A$ | $a + X/2^A$ |
| $6Y/2^A$ | $a + X/2^A$ |

In the threshold voltage change sensing operation 6̂, the ADC can sense the saturated voltage Vdata2−(Vth1+ΔVth1) =Vdata1−ΔVth1 of the second node N2 of the drive transistor DRT in units of $Y/2^A$ V. The threshold voltage variation according to the initial threshold voltage Vth1 is as in Table 5.

TABLE 5

| Vth1 (V) | Sensed ΔVth1 (V) | ADC output |
|---|---|---|
| $Y/2^A$ | $-5Y/2^A$ | −5 |
| $2Y/2^A$ | $-4Y/2^A$ | −4 |
| $3Y/2^A$ | $-3Y/2^A$ | −3 |
| $4Y/2^A$ | $-2Y/2^A$ | −2 |
| $5Y/2^A$ | $-Y/2^A$ | −1 |
| $6Y/2^A$ | 0 | 0 |

In the data compensation amount calculating operation 7̂, the timing controller 140 saves the threshold voltage variation ΔVth1 of the ADC in the memory 1360 as a voltage higher than the sensing voltage per unit bit of the ADC.

In the data compensation amount calculating operation 7̂, when calculating the data compensation amount ΔData (Vth1+ΔVth1) of each of the subpixels, the timing controller 140 may calculate the data compensation amount ΔData (Vth1+ΔVth1) in units of Y V/A-bits or $Y/2^A$ V/bit that is the sensing voltage resolution of the ADC, but may change the basic unit of the data compensation amount ΔData (Vth1) in order to increase the compensation range to compensate for the initial threshold voltage with the wide dispersion. For example, the timing controller 140 calculates the data compensation amount ΔData (Vth1+ΔVth1) in units of Z V/A-bit $=Z/2^A$ V/bit as in Table 6.

TABLE 6

| Sensed ΔVth1 (V) | ΔData update value (Bit) |
|---|---|
| $-5Y/2^A$ | −2 |
| $-4Y/2^A$ | −2 |
| $-3Y/2^A$ | −1 |
| $-2Y/2^A$ | −1 |
| $-Y/2^A$ | 0 |
| 0 | 0 |

The timing controller 140 calculates the threshold voltage variation ΔVth1 of each of the relevant subpixels and the initial threshold voltage Vth1, and saves the calculated result in the memory 1360 as the final or updated data compensation amount ΔData (Vth1+ΔVth1) as in Table 7.

TABLE 7

| Initial Vth1 (V) | Sensed ΔVth1 (V) | Updated Vth2 (V) | Value stored as ΔData (Bit) |
|---|---|---|---|
| $Y/2^A$ | $-5Y/2^A$ | $-4Y/2^A$ | −2 |
| $2Y/2^A$ | $-4Y/2^A$ | $-2Y/2^A$ | −1 |

TABLE 7-continued

| Initial Vth1 (V) | Sensed ΔVth1 (V) | Updated Vth2 (V) | Value stored as ΔData (Bit) |
|---|---|---|---|
| $3Y/2^A$ | $-3Y/2^A$ | 0 | 0 |
| $4Y/2^A$ | $-2Y/2^A$ | $2Y/2^A$ | 1 |
| $5Y/2^A$ | $-Y/2^A$ | $4Y/2^A$ | 2 |
| $6Y/2^A$ | 0 | $6Y/2^A$ | 3 |

Since the OLED display device 100 according to the exemplary embodiments repeats the operation of sensing and compensating for the updated threshold voltage of the subpixel, the OLED display device 100 corrects the threshold voltage deviation between the drive transistors by reflecting the threshold voltage variation of each of the drive transistors after a predetermined time has elapsed, thereby reducing or removing differences in the luminance between the subpixels. Thereby, it is possible to improve image quality.

Figure 15:
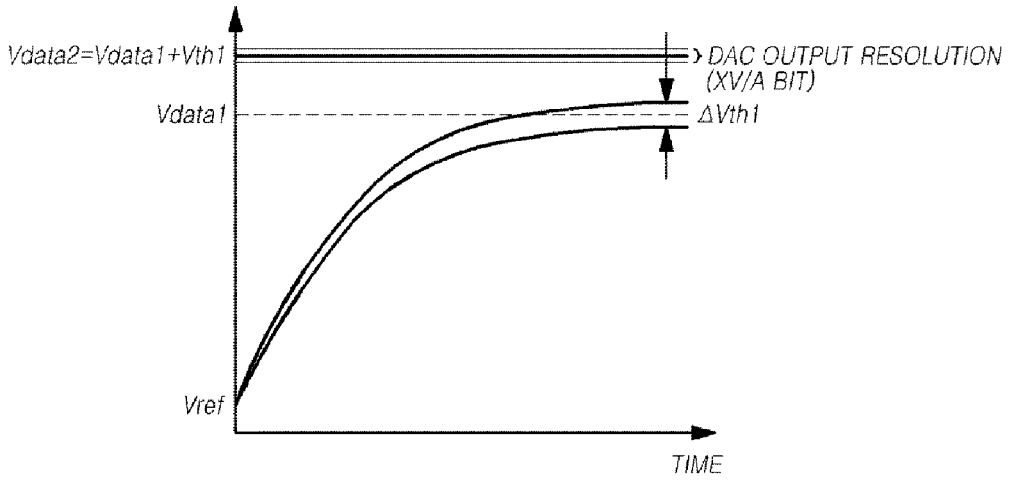
FIG. 15 illustrates a sensing voltage error generated according to the output voltage resolution of the data voltage.

FIG. 15 illustrates a sensing voltage error generated according to the output voltage resolution of the data voltage Vdata.

Referring to FIG. 15, when sensing the initial threshold voltage and the updated threshold voltage of the aforementioned display device, the DAC of the data driver 120 expresses the output gamma reference voltage as A bits. Thus, the data voltage Vdata or Vdata' applied to the gate of the drive transistor DRT of each sub-pixel is expressed by diving the output voltage of the DAC of the data driver 120 by the A bits. Therefore, the DAC of the data driver 120 has a limit to precisely outputting the data voltage Vdata or Vdata' applied to the gate of the drive transistor DRT of each sub-pixel because the magnitude of the voltage corresponding to 1 bit is set to in $X/2^A$ V/bit in the aforementioned example. The output voltage resolution of the DAC of the data driver 120 is insufficient, and the ability to precisely sensing the threshold voltage Vth1 and the threshold voltage variation ΔVth2 is limited.

Upon sensing the initial threshold voltage and the updated threshold voltage of the aforementioned display device, since the threshold voltage Vth1 and the threshold voltage variation ΔVth1 are not sensed in a more precise unit, the compensation for the threshold voltage Vth is not perfect and stains may form on a screen having low-grayscale luminance.

In the OLED display device 100 according to the exemplary embodiments as described above, there may be a difference in resolution between the DAC of the data driver 120 which applies the data voltage Vdata to the sub-pixel of interest, the ADC that senses the threshold voltage Vth, and the memory 1360 that stores the result obtained by calculating the threshold voltage variation ΔVth of each of the sub-pixels and the resultant data compensation amount ΔData based on the sensing data Dsen. Hereinafter, a structure for sensing and compensating for the threshold voltage using the DAC, the ADC, and the memory that have different resolutions will be described with reference to the drawings.

Figure 16:
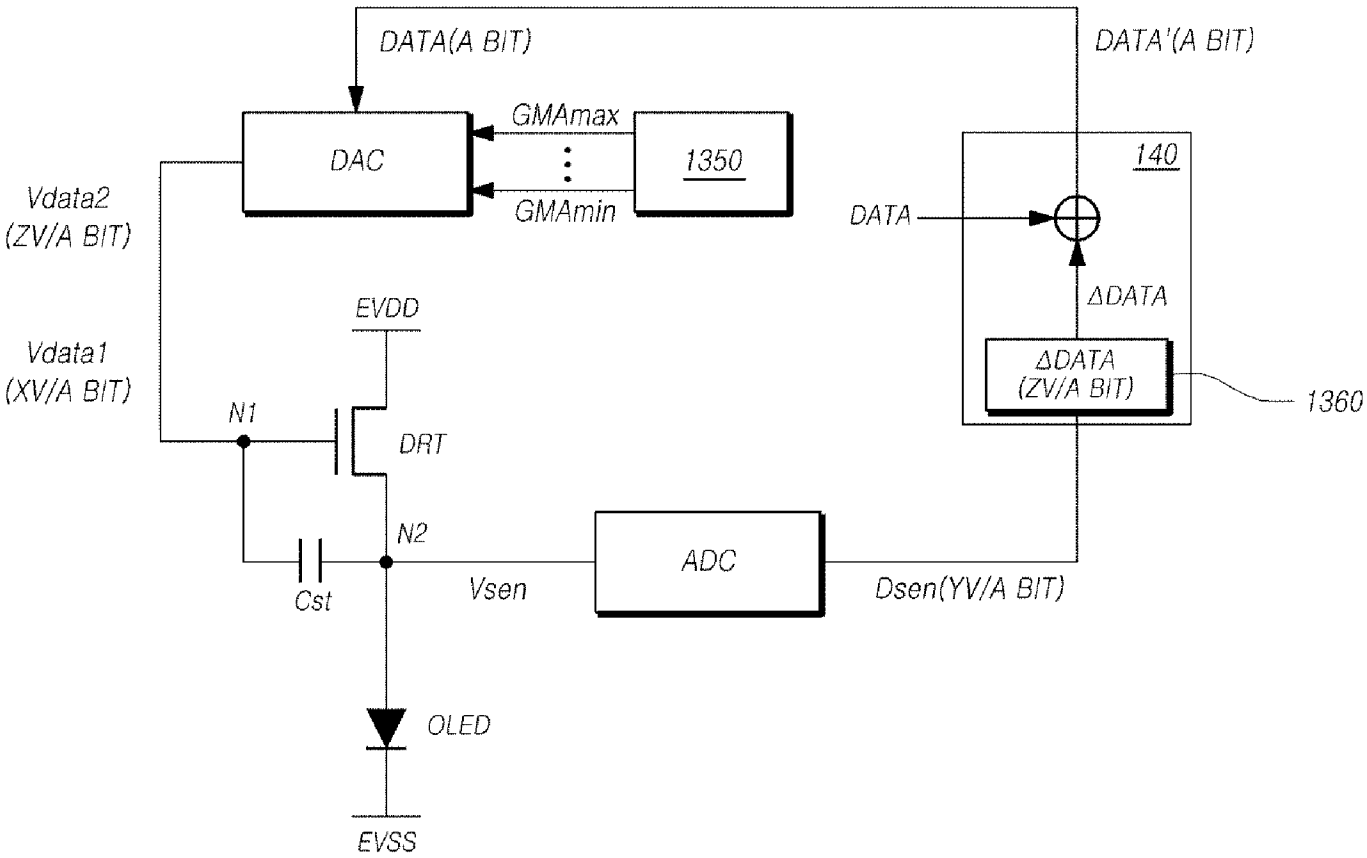
FIG. 16 is a circuit diagram illustrating a sensing and compensating configuration of the sub-pixel in the OLED display device 100 according to the exemplary embodiments.
Figure 17:
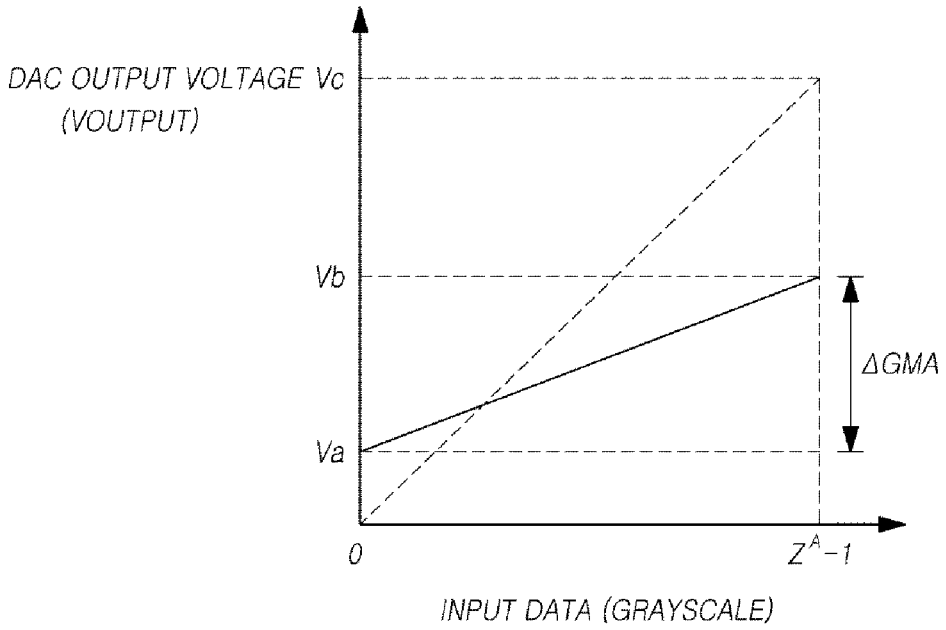
FIG. 17 is a graph illustrating a gamma reference voltage applied to the data driver when sensing a threshold voltage.

FIG. 16 is a circuit diagram illustrating a sensing and compensating configuration of the sub-pixel in the OLED display device 100 according to the exemplary embodiments. FIG. 17 is a graph illustrating a gamma reference voltage applied to the data driver when sensing a threshold voltage.

Referring to FIG. 16, in the event of sensing and driving operations, the DAC provides a data voltage Vdata corresponding to data Data to the gate of the drive transistor DRT.

Here, the data Data may include A-bit image data. Further, the gamma reference voltage supply circuit 1350 provides $2^A$ gamma reference voltages corresponding to "A" bits to the DAC.

As illustrated in FIG. 17, gamma reference voltages which the gamma reference voltage supply circuit 1350 applies to the data driver may be varied. The gamma reference voltage supply circuit 1350 supplies gamma reference voltages within a gamma reference voltage range ΔGMA between the minimum gamma reference voltage GMAmin and the maximum gamma reference voltage GMAmax, and varies at least one of the minimum gamma reference voltage GMAmin and the maximum gamma reference voltage GMAmax to be able to vary the gamma reference voltages.

In the event of the initial threshold voltage sensing operation and the driving operation, the minimum gamma reference voltage GMAmin may be 0 V, and the maximum gamma reference voltage GMAmax may be Vc V. Further, when updating the threshold voltage, the minimum gamma reference voltage GMAmin may be Va V, and the maximum gamma reference voltage GMAmax may be Vb V. Therefore, the DAC may express A-bit data as Vc V/A-bits (or $Vc/2^A$ V/bit) in the event of the initial threshold voltage sensing operation and the driving operation, and as (Vb-Va)/A-bits (or $(Vb-Va)/2^A$ V/bit) when updating the threshold voltage. When updating the threshold voltage, an output voltage resolution of the DAC can be increased.

When outputting the data voltage of the DAC, if the range of the output data voltages is reduced, the data voltage capable of expressing the same number of bits is made smaller. When the display device actually drives an image, the range of the output data voltages should be great, but the range of the output data voltages used when sensing the threshold voltage is narrower. For this reason, in the event of the sensing operation, the range of the output data voltages is reduced. Thereby, it is possible to increase sensing voltage resolutions of the threshold voltage Vth and the threshold voltage variation ΔVth.

For example, in the event of the initial threshold voltage sensing operation and the driving operation, the maximum gamma reference voltage GMAmax may be, for example, X V. Therefore, the DAC receives the A-bit data Data from the timing controller 140 and the $2^A$ gamma reference voltages from the gamma reference voltage supply circuit 1350, and provides $2^A$ data voltages Vdata1 to the gate of the drive transistor DRT. As a result, the output voltage resolution of the DAC can express $X/2^A$ V per one bit as X V/A-bits.

In another example, the maximum gamma reference voltage GMAmax when sensing the updated threshold voltage may be lower than the maximum gamma reference voltage GMAmax in the event of the threshold voltage sensing operation and the driving operation. According to the aforementioned example, the sensing voltage resolution of the ADC can express $Y/2^A$ V per one bit as Y V/A-bits.

When sensing and compensating for the initial threshold voltage of the sub-pixel of the OLED display device 100 according to the present embodiments, in the initializing operation $\hat{1}$, as described with reference to FIG. 13, the ADC can sense the saturated voltage Vg−Vth1=Vdata1−Vth1 of the second node N2 of the drive transistor DRT in units of $Y/2^A$ V.

The timing controller 140 may calculate the initial threshold voltage Vth1, and store the calculated result in the memory 1360 as the data compensation amount ΔData. The timing controller 140 may calculate the data compensation amount ΔData (Vth1) using the threshold voltage Vth1 of each of the sub-pixels in units of Z V/A bits=$Z/2^A$ V/bit as in Table 2.

In the sub-pixel compensating operation $\hat{3}$, when arriving at timing to drive the sub-pixels arrives, the timing controller 140 converts the data compensation amount ΔData (Vth1) stored in the memory 1360 to be harmonious with the output voltage resolution ($X/2^A$ V/bit) of the DAC as in Table 8, and supplies the compensated data Data1'=Data1+ΔData (Vth1) to the data driver 120.

TABLE 8

| Sensed Vth1 (V) | Value stored as ΔData (Bit) | Down−converted ΔData value (Bit) |
|---|---|---|
| $Y/2^A$ | 1 | 1 |
| $2Y/2^A$ | 1 | 1 |
| $3Y/2^A$ | 2 | 1 |
| $4Y/2^A$ | 2 | 1 |
| $5Y/2^A$ | 3 | 1 |
| $6Y/2^A$ | 3 | 1 |

Similarly, when sensing the updated threshold voltage of the sub-pixel, in operation $\hat{4}$, the DAC applies the compensated data voltage Vdata2=Vdata1+Vth1 corresponding to the compensated data Data1'=Data1+ΔData (Vth1) of the relevant sub-pixel to the first node N1 of the drive transistor DRT within the sub-pixel of interest. The data voltage Vdata is fixed as a V, and the data compensation amount ΔData (Vth1) converted to be harmonious with the output voltage resolution ($Z/2^A$ V/bit) of the DAC is as in Table 9. Thus, the compensated data voltage Vdata2=Vdata1+Vth1 may be as in Table 9. Here, Z may be greater than Y. Hereinafter, it is assumed that Z=2Y, but this is not intended to be limiting.

TABLE 9

| Sensed Vth1 (V) | Value stored as ΔData (Bit) | Applied Voltage (V) (DAC output) |
|---|---|---|
| $Y/2^A$ | 1 | $a + (2Y/2^A)$ |
| $2Y/2^A$ | 1 | $a + (2Y/2^A)$ |
| $3Y/2^A$ | 2 | $a + (4Y/2^A)$ |
| $4Y/2^A$ | 2 | $a + (4Y/2^A)$ |
| $5Y/2^A$ | 3 | $a + (6Y/2^A)$ |
| $6Y/2^A$ | 3 | $a + (6Y/2^A)$ |

In the threshold voltage variation sensing operation $\hat{6}$, the ADC senses the saturated voltage Vdata2−ΔVth1=Vdata1+Vth1−ΔVth1 of the second node N2 of the drive transistor DRT in units of $Y/2^A$ V. The threshold voltage variation ΔVth1 according to the initial threshold voltage Vth1 is as in Table 10.

TABLE 10

| Previous Vth1 (V) | Sensed ΔVth1 (V) | ΔData update value (Bit) |
|---|---|---|
| $Y/2^A$ | $-Y/2^A$ | −1 |
| $2Y/2^A$ | 0 | 0 |
| $3Y/2^A$ | $-Y/2^A$ | −1 |
| $4Y/2^A$ | 0 | 0 |
| $5Y/2^A$ | $-Y/2^A$ | −1 |
| $6Y/2^A$ | 0 | 0 |

In the data compensation amount calculating operation $\hat{7}$, when calculating the data compensation amount ΔData (Vth1+ΔVth) of each of the sub-pixels, the timing controller 140 calculates the data compensation amount ΔData (Vth1+

ΔVth1) using the previous data compensation amount ΔData (Vth1) and the threshold voltage variation ΔVth1, for instance, in units of Z V/A-bits=Z/$2^A$ V/bit as in Table 11.

TABLE 11

| ΔVth1 (V) | ΔData update value (Bit) |
|---|---|
| $-Y/2^A$ | — |
| 0 | 0 |
| $-Y/2^A$ | — |
| 0 | 0 |
| $-Y/2^A$ | — |
| 0 | 0 |

The timing controller 140 calculates the final data compensation amount Data (Vth1+ΔVth1) of each of the sub-pixels using the threshold voltage variation ΔVth1 of each of the relevant sub-pixels and the initial threshold voltage Vth1, and store the calculated result in the memory 1360.

TABLE 12

| Initial Vth1 (V) | Sensed ΔVth1 (V) | Updated Vth2 (V) | Value stored as ΔData (Bit) |
|---|---|---|---|
| $Y/2^A$ | $-Y/2^A$ | 0 | 0 |
| $2Y/2^A$ | 0 | $2Y/2^A$ | 1 |
| $3Y/2^A$ | $-Y/2^A$ | $2Y/2^A$ | 1 |
| $4Y/2^A$ | 0 | $4Y/2^A$ | 2 |
| $5Y/2^A$ | $-Y/2^A$ | $4Y/2^A$ | 2 |
| $6Y/2^A$ | 0 | $6Y/2^A$ | 3 |

Figure 18:
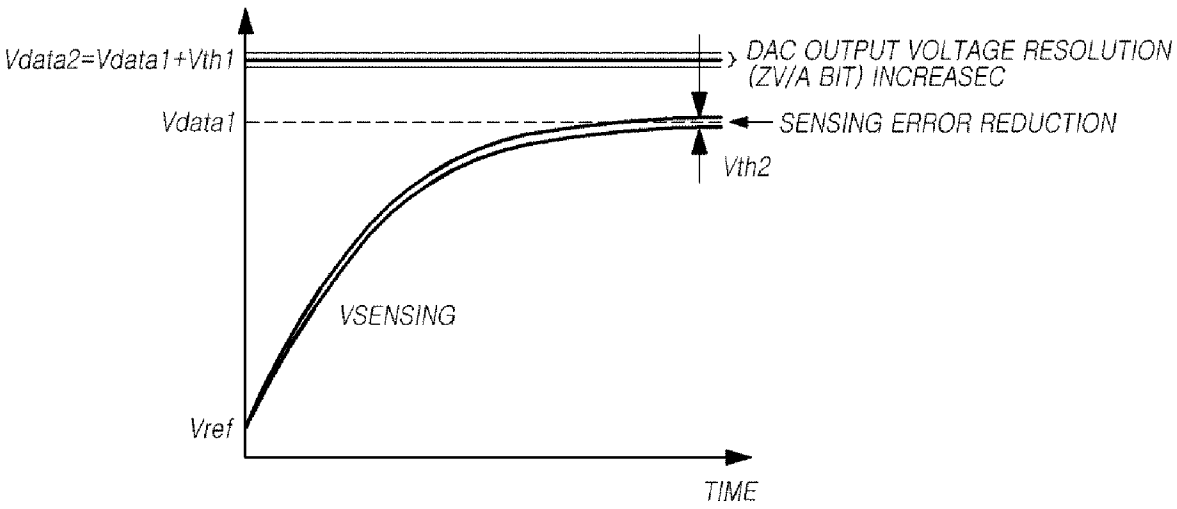
FIG. 18 is a graph illustrating an improvement in the sensed voltage error of the threshold voltage according to changes in the gamma reference voltage applied to the data driver when sensing the threshold voltage.

FIG. 18 is a graph illustrating an improvement in the sensed voltage error of the threshold voltage according to changes in the gamma reference voltage applied to the data driver when sensing the threshold voltage.

Referring to FIG. 18, when sensing the threshold voltage Vth1 and the threshold voltage variation ΔVth1 of the display device, the gamma reference voltage applied to the data driver can be reduced, and the DAC can express, as illustrated in FIG. 17, the A-bit data as Vc/A-bits in the event of the initial threshold voltage sensing operation and the driving operation, but as (Vb−Va)/A-bits when updating the threshold voltage. Thus, updating the threshold voltage, the output voltage resolution of the DAC can be increased. Thereby, the output data voltage applied to the data driver 120 can be made more minute, and the threshold voltage Vth and the threshold voltage variation ΔVth can be more accurately sensed.

In the display device as set forth above, it is possible to sense the threshold voltage Vth1 and the changes ΔVth1 in the threshold voltage in more precise units in the operation of sensing an initial threshold voltage and an updated threshold voltage. It is therefore possible to more completely compensate for the threshold voltage Vth, whereby no stains form on the screen having low-grayscale luminance.

The foregoing descriptions and the accompanying drawings have been presented in order to explain the certain principles of the present invention. A person skilled in the art to which the invention relates can make many modifications and variations by combining, dividing, substituting for, or changing the elements without departing from the principle of the invention. The foregoing embodiments disclosed herein shall be interpreted as illustrative only but not as limitative of the principle and scope of the invention. It should be understood that the scope of the invention shall be defined by the appended Claims and all of their equivalents fall within the scope of the invention.

What is claimed is:

1. An organic light-emitting diode display device comprising:

an organic light-emitting diode display panel on which subpixels are disposed;

a gamma reference voltage supply circuit supplying gamma reference voltages, the gamma reference voltages having a first voltage range during driving of an organic light-emitting diode and having a second voltage range different than the first voltage range when sensing a threshold voltage of a driving transistor for driving the organic light-emitting diode;

a data driver supplying data voltages to data lines, the data voltages generated based on a data signal and the gamma reference voltages, wherein the data driver senses a voltage of a sensing node within each of the subpixels in sensing mode; and a timing controller controlling the data driver, wherein the timing controller performs a compensation process based on the voltage sensed by the data driver.

2. The organic light-emitting diode display device according to claim 1, wherein the gamma reference voltage supply circuit supplies the gamma reference voltages within a predetermined gamma reference voltage range between a minimum gamma reference voltage and a maximum gamma reference voltage, and varies at least one of the minimum gamma reference voltage and the maximum gamma reference voltage, thereby varying the gamma reference voltages between the first voltage range and the second voltage range.

3. The organic light-emitting diode display device according to claim 2, wherein the digital-to-analog converter supplies the data voltages based on the gamma reference voltages within the predetermined gamma reference voltage range to the data lines during normal driving.

4. The organic light-emitting diode display device according to claim 1, wherein the data driver comprises:

a digital-to-analog converter supplying the data voltages based on the gamma reference voltages to the data lines; and an analog-to-digital converter sensing a voltage of a sensing node within each of the subpixels in the sensing mode, wherein the digital-to-analog converter supplies the data voltages based on the gamma reference voltages in a predetermined gamma reference voltage range, and supplies the data voltages based on the gamma reference voltages in a range narrower than the predetermined gamma reference voltage range to the data lines when the threshold voltage is updated, and wherein the analog-to-digital converter senses a threshold voltage of a driving transistor of each of the subpixels when sensing an initial threshold voltage, and senses a change in the threshold voltage of the driving transistor of each of the subpixels when the threshold voltage is updated.

5. The organic light-emitting diode display device according to claim 4, further comprising a memory, wherein the timing controller saves the threshold voltage of the driving transistor of each of the subpixels sensed by the analog-to-digital converter in the memory when sensing the initial threshold voltage, and supplies compensated data based on the threshold voltage to the data driver during driving, and wherein the timing controller saves the change in the threshold voltage of the driving transistor of each of the subpixels sensed by the analog-to-digital converter in the memory when sensing the initial threshold voltage, and supplies compensated data based on the threshold voltage and the change in the threshold voltage during driving.

6. The organic light-emitting diode display device according to claim 5, wherein the timing controller saves the threshold voltage and the change in the threshold voltage sensed by the analog-to-digital converter in the memory as a voltage per bit higher than a voltage per bit sensed by the analog-to-digital converter.

7. The organic light-emitting diode display device according to claim 1, wherein each of the subpixels comprises:

an organic light-emitting diode;

the driving transistor comprising a first node to which the data voltages are applied, a second node connected to a first electrode of the organic light-emitting diode, and a third node electrically connected to a driving voltage line;

a first transistor electrically connected between a corresponding data line of the data lines through which the data voltages are supplied and the first node of the driving transistor;

a second transistor electrically connected between a reference voltage line through which a reference voltage is supplied and a second node of the driving transistor; and a capacitor electrically connected between the first node and the second node of the driving transistor.

8. An organic light-emitting diode display device comprising:

an organic light-emitting diode display panel comprising:

a subpixel having a driving transistor coupled to a sensing node; and a data line coupled to the subpixel;

a data driver to drive a data voltage signal onto the data line based on a data signal and gamma reference voltages, and to sense a voltage of the sensing node during a threshold voltage sensing mode, the data driver supplying the data voltage signal during both the threshold voltage sensing mode and a display driving mode corresponding to image display; and a gamma reference voltage supply circuit to supply the gamma reference voltages to the data driver, the gamma reference voltages having a first voltage range during the display driving mode and having a second voltage range different than the first voltage range during the threshold voltage sensing mode.

9. The organic light-emitting diode display device of claim 8, further comprising:

a timing controller to control the data driver, the timing controller configured to receive a digital data and compensating the received digital data signal with a stored threshold voltage value.

10. The organic light-emitting diode display device of claim 8, wherein the first voltage range is larger than the second voltage range.

11. The organic light-emitting diode display device of claim 8, wherein the second voltage range starts at a voltage level greater than zero volts.

12. The organic light-emitting diode display device of claim 8, wherein the gamma reference voltage has the first voltage range during an initial threshold voltage sensing mode and the second voltage range during a update threshold voltage sensing mode.

13. A method comprising:

sensing a threshold voltage of a driving transistor of a subpixel of an organic light-emitting diode display panel comprising:

generating a first set of gamma reference voltages in a first voltage range, driving the driving transistor based on the first set of gamma reference voltages, and determining a threshold voltage of the driving transistor based on an output of the driving transistor; and operating the driving transistor during a display driving mode corresponding to image display comprising:

generating a second set of gamma reference voltages in a second voltage range, different than the first voltage range, receiving a data signal corresponding to a brightness level of the subpixel, generating a drive voltage signal based on the data signal and the generated second set of gamma reference voltages, and driving the driving transistor based on the drive voltage signal.

14. The method of claim 13, wherein the second voltage range is larger than the first voltage range.

15. The method of claim 13, wherein the first voltage range starts at a voltage level greater than zero volts.

16. The method of claim 13, further comprising:

sensing an initial threshold voltage of a driving transistor of a subpixel of an organic light-emitting diode display panel comprising:

generating a third set of gamma reference voltages in the second voltage range, driving the driving transistor based on the third set of gamma reference voltages, and determining a threshold voltage of the driving transistor based on an output of the driving transistor.

17. The method of claim 13, wherein operating the driving transistor during the display driving mode corresponding to image display further comprises:

compensating the received data signal based on the threshold voltage of the driving transistor.

18. The method of claim 13, wherein sensing the threshold voltage of the driving transistor further comprises:

updating a stored threshold voltage of the driving transistor based on the output of the driving transistor.

19. The method of claim 13, wherein sensing the threshold voltage of the driving transistor further comprises:

coupling an output node of the driving transistor to a reference voltage to charge a capacitor connected between an input node of the driving transistor and the output node of the driving transistor; and responsive to the capacitor being charged, coupling the output node of the driving transistor to a sensing circuit.

20. The method of claim 19, wherein the sensing circuit is an analog-to-digital converter circuit.

* * * * *